US006736279B2

(12) United States Patent
Allen

(10) Patent No.: US 6,736,279 B2
(45) Date of Patent: May 18, 2004

(54) CONNECTION ASSEMBLY FOR FOOD SERVICE CARTS, SHELVING UNITS, SIGNAGE AND OTHER MULTI-COMPONENT PRODUCTS

(75) Inventor: Richard D. Allen, Fairbury, NE (US)

(73) Assignee: Prairie View Industries, Inc., Fairbury, NE (US)

( * ) Notice: Subject to any disclaimer, the term of this patent is extended or adjusted under 35 U.S.C. 154(b) by 0 days.

(21) Appl. No.: 09/754,694

(22) Filed: Jan. 3, 2001

(65) Prior Publication Data

US 2002/0084237 A1 Jul. 4, 2002

(51) Int. Cl.[7] ..... A47B 43/00
(52) U.S. Cl. ..... 211/189; 403/174; 403/218
(58) Field of Search ..... 211/189, 182, 211/126.1, 126.2, 133.1, 187; 280/79.3; 403/174, 312, 297, 218

(56) References Cited

U.S. PATENT DOCUMENTS

| | | | | | |
|---|---|---|---|---|---|
| 1,854,777 | A | * | 4/1932 | Bales | 211/126.1 |
| 2,936,147 | A | * | 5/1960 | Stewart | 248/243 |
| 3,136,395 | A | * | 6/1964 | Rebelle | 189/34 |
| 3,561,715 | A | * | 2/1971 | Klein | 248/243 |
| 3,585,768 | A | * | 8/1971 | Klein | 52/731 |
| 3,648,419 | A | * | 3/1972 | Marks | 52/36 |
| 3,834,549 | A | * | 9/1974 | Burg et al. | 211/148 |
| 170,399 | A | * | 11/1975 | Reynolds | 211/189 X |
| 3,986,316 | A | * | 10/1976 | Blodee | 52/753 D |
| 4,047,342 | A | * | 9/1977 | Boula | 52/239 |
| 4,063,835 | A | * | 12/1977 | Husband et al. | 403/252 |
| 4,348,129 | A | * | 9/1982 | Conforti | 403/218 |
| 4,419,938 | A | * | 12/1983 | Kaut | 108/111 |
| 4,441,300 | A | * | 4/1984 | Varon et al. | 52/732 |
| 4,443,979 | A | * | 4/1984 | Varon et al. | 52/36 |
| 4,513,669 | A | * | 4/1985 | Steinke | 108/107 |
| 4,527,490 | A | * | 7/1985 | Tipton et al. | 108/111 |
| 4,535,525 | A | * | 8/1985 | Varon et al. | 29/463 |
| 4,570,402 | A | * | 2/1986 | Johnson | 52/241 |
| 4,712,286 | A | * | 12/1987 | Wolf | 29/463 |

(List continued on next page.)

OTHER PUBLICATIONS

Marketing Catalog, Refrigerator/Proofer Racks, New Age Industrial Corporation, 1000 E. Highway 36, Norton, KS 67654 on sale more than one year prior to the filing date of the present application.

Order Sheet, Pan Racks, Advance TABCO, 200 Heartland Blvd., Edgewood, NY 11717, on sale more than one year prior to the filling date of the present application.

Marketing Catalog, p. 68, Bun Pan Rack, International Storage Systems (ISS), Covington, GA, on sale more than one year prior to the filling date of the present application.

Marketing Catalog, p. 7, Donut Screen Rack and Poly Box Rack, Win–Holt Equipment Group, 855 Merrick Avenue, Westbury, NY 11590, on sale more than one year prior to the filling date of the present application.

*Primary Examiner*—Daniel P. Stodola
*Assistant Examiner*—Khoa Tran
(74) *Attorney, Agent, or Firm*—Stinson Morrison Hecker LLP

(57) ABSTRACT

A connection assembly for connecting parts of a multi-component product comprising a post having two releasably interlocking sides and an extension member. A slot provided in the exterior sidewall of the post at the juncture of the interlocking sides is configured to mate with the extension member. The extension member may be engaged with the slot when the two sides of the post are in a separated unlocked position. The two sides may then be placed in an interlocking position so as to fixedly connect the extension member therebetween.

12 Claims, 5 Drawing Sheets

U.S. PATENT DOCUMENTS 4,785,946 A * 11/1988 Sorensen ..... 211/187
4,934,858 A * 6/1990 Beaulieu ..... 403/174
4,998,023 A * 3/1991 Kitts ..... 280/47.35
5,409,122 A * 4/1995 Lazarus ..... 211/186
5,499,885 A * 3/1996 Chapman ..... 403/380
5,802,798 A * 9/1998 Martens ..... 52/653.1
5,918,750 A * 7/1999 Jackson ..... 211/189
5,957,614 A * 9/1999 Aurich ..... 403/170
6,047,838 A * 4/2000 Rindoks et al. ..... 211/187
6,223,917 B1 * 5/2001 Bruder ..... 211/189

* cited by examiner

CONNECTION ASSEMBLY FOR FOOD SERVICE CARTS, SHELVING UNITS, SIGNAGE AND OTHER MULTI-COMPONENT PRODUCTS

BACKGROUND OF THE INVENTION

1. Field of the Invention

The present invention is generally directed to the field of connectors, and is more specifically directed to a connection assembly useful for releasably securing parts of a multi-component product together in a manner that reduces production costs and enhances the overall appearance of the product.

2. Description of the Related Art

Many products consist of multiple components or parts connected to one another using various means of attachment such as welding, glue, nails, screws and the like. The amount of labor and/or machine time required to connect these parts together during production can have a dramatic impact on the overall time and cost of production, particularly for relatively inexpensive products having multiple parts.

For example, shelving carts used by the food service industry to store, display and transport trays or tubs of food and dishes are fairly simple in construction. The carts are typically rectangular in shape formed by four outer vertical posts riding on stem casters. The posts are secured to one another by horizontally extending stabilizing rods. The shelving is formed by support rods vertically stacked one above the other and extending horizontally between the outer posts on each side of the cart. Manufacture and sale of these carts is a highly competitive market. In order to be competitive as a cart manufacturer, it is necessary to produce carts in an efficient and cost effective manner.

The major manufacturing expenses for carts of this type are raw material costs and labor or machine time. While manufacturers have little control over the costs of raw materials, they can control the labor or machine time costs through more efficient manufacturing techniques. A large portion of the labor or machine time costs is associated with assembly of the carts. The carts are typically made by welding or bolting the support rods to the outer posts of the cart. In a cart having five shelving units, this would require twenty welds or bolts (ten support rods, one on either side of the cart, attached to a post at each end of the support rod). Welding the rod to each post is a labor-intensive job, requiring a large number of man-hours to produce each cart. In order to reduce the large number of man-hours, the welding is done as quickly as possible. Thus, in addition to high labor costs, welding leaves unsightly marks that detract from the overall appearance of the cart. Fastening the rods to the posts with nuts and bolts is better appearance wise, but it also requires a large number of man-hours. In addition, bolt fasteners are relatively expensive in comparison to the angle iron and other materials used for construction of the carts so as to unduly increase the cost of materials.

Thus, a need has developed in the art for a connection assembly that is cost effective to manufacture and assemble, yet is visually attractive in design.

SUMMARY OF THE INVENTION

This need is met by a connection assembly comprising a post and an extension member, wherein the post is formed of interlocking sides that may be releasably secured together. The interlocking sides define a slot in the exterior sidewall of the post at the juncture of the sides. This slot is configured to mateably engage a portion of the extension member. The extension member is fit into the slot when the two sides of the post are in an unlocked position. The two sides are then interlocked to releasably secure the extension member in place.

In use, the post comprises a first component of a product and the extension member comprises a second component of a product, wherein the first and second components are required to be connected to one another. The interlocking sides of the post are pulled apart into an unlocked position. The extension member is inserted into the slot formed within the exterior wall of the post at the juncture of the sides in such a manner as to engage with the slot. The two sides of the post are then brought back together into interlocking engagement. In this manner the two components of the product are connected together without the use of welding, glue, screws, nails or other time consuming connection means. The components are secured in a releasable manner such that the product can be easily disassembled if needed for parts replacement or repair. Furthermore, the appearance of the product is clean and finished without unsightly welds or protruding bolts.

In a preferred embodiment of the invention, the extension member comprises a support rod having a pair of opposed notches near an end of the rod. The notches are configured to mateably engage with the slot. The support rod has an end section extending from the opposed notches to the end of the rod. This end section is configured to be received within a cavity that is formed within the interior of the post by the two interlocking sides.

The interlocking sides of the post preferably include a plurality of fingers extending inwardly toward the interior of the post. The fingers are positioned adjacent one another with spaces between each finger. Abutment walls formed along the sides of the fingers run parallel one another. The fingers of the first interlocking side of the post are configured to fit within corresponding spaces of the second interlocking side of the post. In this manner, the abutment walls of the fingers of one side abut corresponding abutment walls of the fingers of the other side so as to prevent the sides from moving relative to one another in a direction transverse the abutment walls when in the interlocked position. Thus, the only way to unlock the two sides from engagement is to slide the sides apart in a direction parallel the abutment walls.

A locking channel is also preferably formed within the interior of the post to receive a locking pin. The locking pin is configured and positioned within the locking channel to substantially prevent the sides from moving relative to one another in a direction parallel the abutment walls. Thus, the locking pin may be inserted into the locking channel once the sides are in the interlocking position so as to prevent disengagement of the sides.

In a most preferred embodiment of the invention, the connection assembly is used in a shelving cart or other shelving unit having multiple shelves. The shelving cart comprises a plurality of vertically extending outer posts having interlocking sides as heretofore described. A plurality of slots are provided within the exterior sidewall of each post at the juncture of the interlocking sides. The slots are preferably spaced equally along the length of the post at the desired location of each shelf. The shelves are formed by support rods connected to two posts, one at either end of the rod, via engagement with the slots. Preferably, each support rod includes a pair of opposed notches near each end of the rod. These notches are configured to mate with a slot formed in the respective post. A locking channel within the interior of the post is configured to receive one or more locking pins that secure the interlocking sides of the post in the interlocking position after the support rod is engaged with the slot. Preferably, each post includes a locking pin configured to fit within a locking channel in the top and bottom of the post. Most preferably, the locking pin at the bottom of the post is formed by the stem of a stem caster. In this manner, the stem is used as a locking pin to secure the interlocking sides together and as a means of connecting the stem caster to the bottom of the post.

In another embodiment of the invention, the connection assembly is used in signage such as for a signpost. The signpost includes a vertically extending post comprising interlocking sides as heretofore described. One or more slots are provided within the exterior sidewall of the post at the juncture of the interlocking sides in the desired location of a sign support. An end of the sign support is configured to fit between the interlocking sides within the slot so as to connect the support to the post. The post may include a locking channel as heretofore described to receive a locking pin for securing the interlocking sides of the post in the interlocked position.

DETAILED DESCRIPTION OF PREFERRED EMBODIMENT

Figure 1:
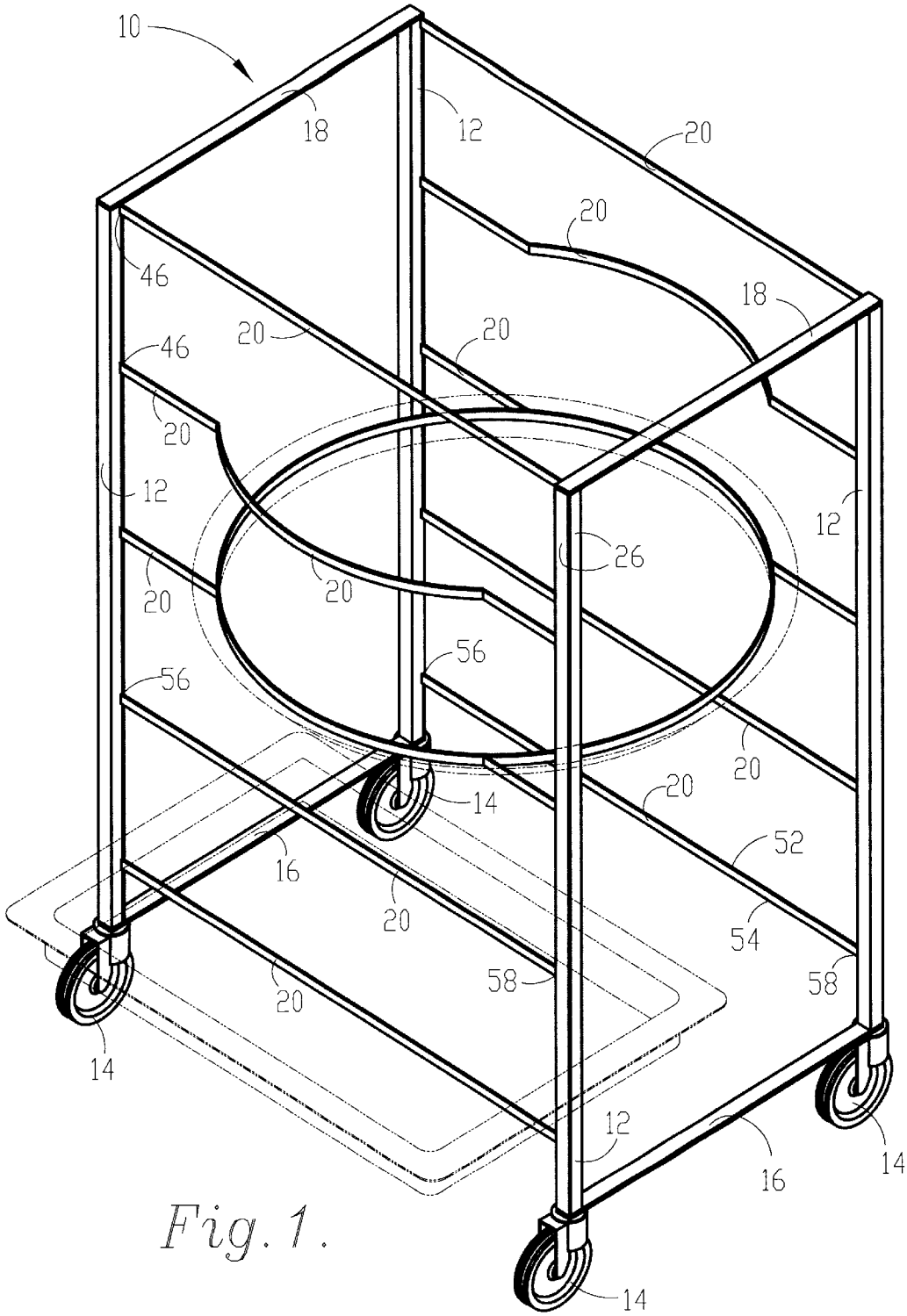
FIG. 1 is a pictorial view of a shelving cart having a plurality of connection assemblies in accordance with a preferred embodiment of the present invention.

Referring initially to FIG. 1, a shelving cart having a plurality of connection assemblies in accordance with a preferred embodiment of the present invention is generally designated by the reference numeral 10. Cart 10 has four substantially vertical outer posts 12 mounted on stem casters 14. The cart is generally rectangular in shape with two posts 12 positioned at the front and two posts 12 positioned at the rear of cart 10. Stabilizing rods 16 are secured and extend between the bottom of the two front and two rear posts. Similarly, cover slats 18 are secured and extend between the top of the two front and two rear posts. A plurality of support rods 20 are connected to and extend between the front and rear posts on the right and left sides of the cart. A round or rectangular tray (shown in dotted lines) may be placed upon the support rods for storage.

Figure 2:
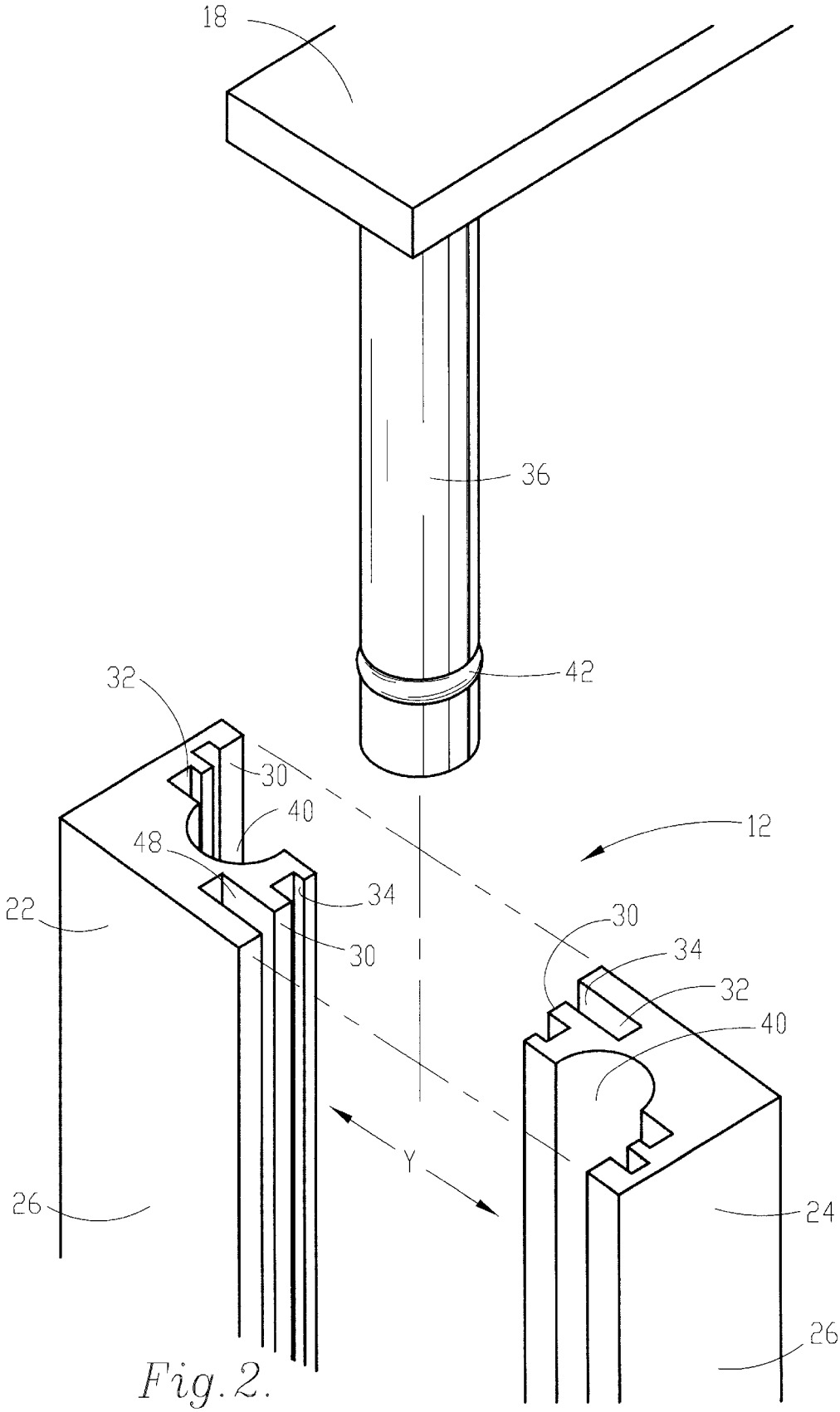
FIG. 2 is an exploded fragmentary view of the cart of FIG. 1 showing the top of a post and a locking pin inserted therein.

Looking to FIG. 2, each post 12 includes two substantially symmetrical sides 22, 24 configured to releasably interlock with one another. Sides 22, 24 may be interlocked together in an interlocked position as shown in FIG. 1, and separated into an unlocked position as shown in FIG. 2. Sides 22, 24 each have two outer walls joined at a right angle so as to define a post exterior sidewall 26 that is generally square in cross-section when the two sides are engaged in the interlocking position. The sides may of course be configured to form other cross-sectional shapes of the post. For example, the sides may instead have one outer wall that is half-moon in shape so as to combine to form a circular exterior sidewall.

The sides can be made from any substantially rigid material, such as metal, wood or plastic. The sides can be made by extruding, molding or other methods know in the art, but in a preferred embodiment, the two sides are each extruded from a piece of 6000 series aluminum alloy. Although the sides are preferably symmetrical, particularly if the post is made by extrusion or molding so as to require only one extrusion die or mold to produce both sides, the sides are not required to be symmetrical.

Each side includes a plurality of fingers 30 which extend inwardly to the interior of post 12 when in the interlocking position. Fingers 30 are positioned adjacent one another with spaces 32 formed between each finger. Abutment walls 34 formed along the sides of fingers 30 adjacent spaces 32 extend generally parallel one another along an axis y. Fingers 30 of the first side 22 are configured to slideably fit within the corresponding spaces 32 of the second side 24 when in the interlocking position.

Figure 4:
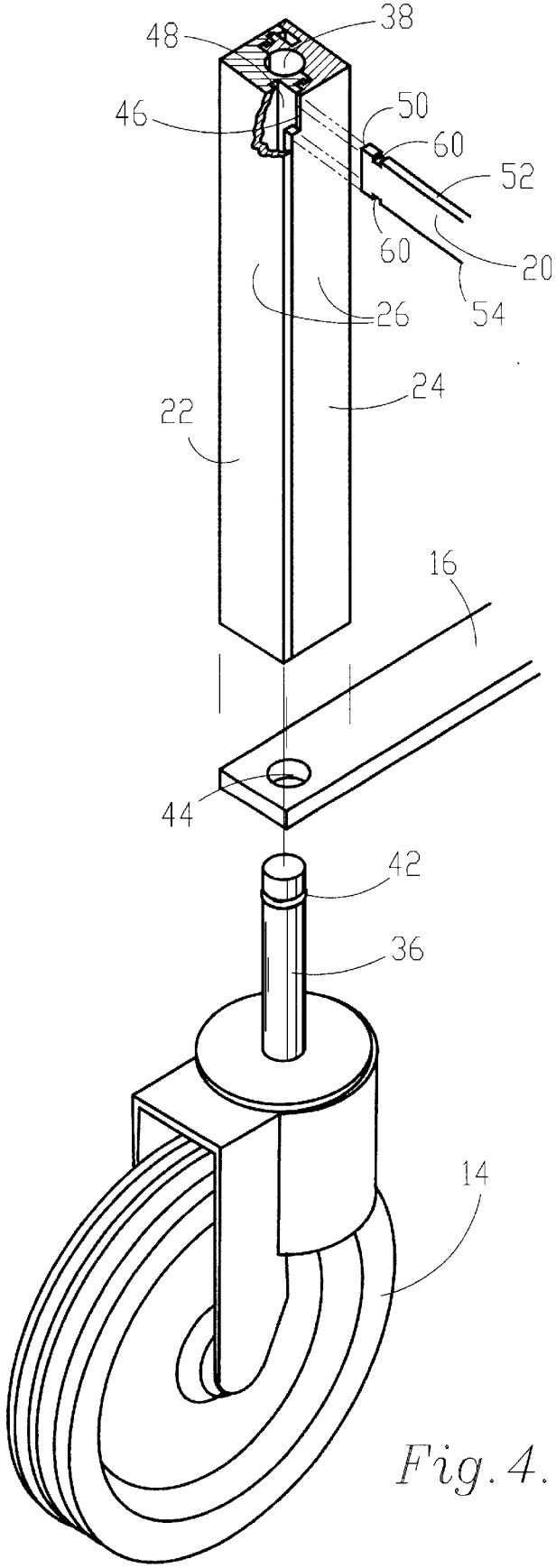
FIG. 4 is a sectional exploded fragmentary view of the cart of FIG. 1 showing a post connected to a support rod and a stem caster, with a portion cut away for clarity.

In order to place the two sides into the interlocking connected position, the sides must be moved toward one another in a sliding direction parallel abutment walls 34. Once in this position, the abutment walls of each side abut one another so as to substantially prevent movement of the interlocking sides in a direction transverse axis y. Thus, the only way to disengage sides 22, 24 is to pull the sides apart in a direction parallel axis y. In order to prevent this parallel type of movement, the sides may be releasably fixed in the interlocking position using any means known in the art including using an interference fit between the sides or a cap on the top and/or bottom of post 12 to hold the sides in position. In the preferred embodiment shown in the drawings, sides 22, 24 are releasably held together by locking pins 36 received within a locking channel 38 at the top of post 12 (FIG. 2) and at the bottom of post 12 (FIG. 4).

Looking specifically to FIG. 2, half-moon cutouts 40 in the interior of sides 22, 24 together form a cylindrical locking channel 38 within the interior of post when the sides are in the interlocking position. In order to prevent movement of the sides in they direction, cutouts 40 are configured such that locking pin 36 will block movement of sides 22, 24 in the y direction when inserted into channel 38. In the embodiment shown in the drawings, cutouts 40 are configured to position a portion of the interlocking fingers of sides 22, 24 along one side of the locking channel and a portion of the interlocking fingers of sides 22, 24 along the other side of locking channel 38. In this manner, when locking pin 36 is inserted into channel 38, the interlocking fingers remain interlocked and the sides cannot move apart in the y direction because movement is blocked by the pin.

Locking pin 36 may be held in place within channel 38 by any means known in the art including by friction fit or interference fit. In the embodiment shown in the drawings, a raised ring 42 along the exterior of pin 36 is configured to fit into a groove (not shown) along the interior wall of the channel. In the embodiment shown in the drawings, locking channel 38 is a centrally located bore that extends longitudinally throughout the length of post 12. However, it should be understood that the channel could be any shape or length provided it is configured to receive the locking pin.

Looking to FIG. 2, in the embodiment shown in the drawings, locking pin 36 inserted into the top of post 12 is integrally formed with cover slat 18. In this manner, the locking pin not only secures sides 22, 24 together in the interlocking position, but also connects cover slat 18 to post 12.

Looking to FIG. 4, locking pin 36 inserted into the bottom of post 12 is integrally formed as the stem of stem caster 14. In addition, a hole 44 in the stabilizing rod 16 is configured to fit over the locking pin. Thus, upon assembly, the locking pin serves not only to secure sides 22, 24 in the interlocking position, but also connects stem caster 14 and stabilizing rod 16 to post 12.

Figure 3:
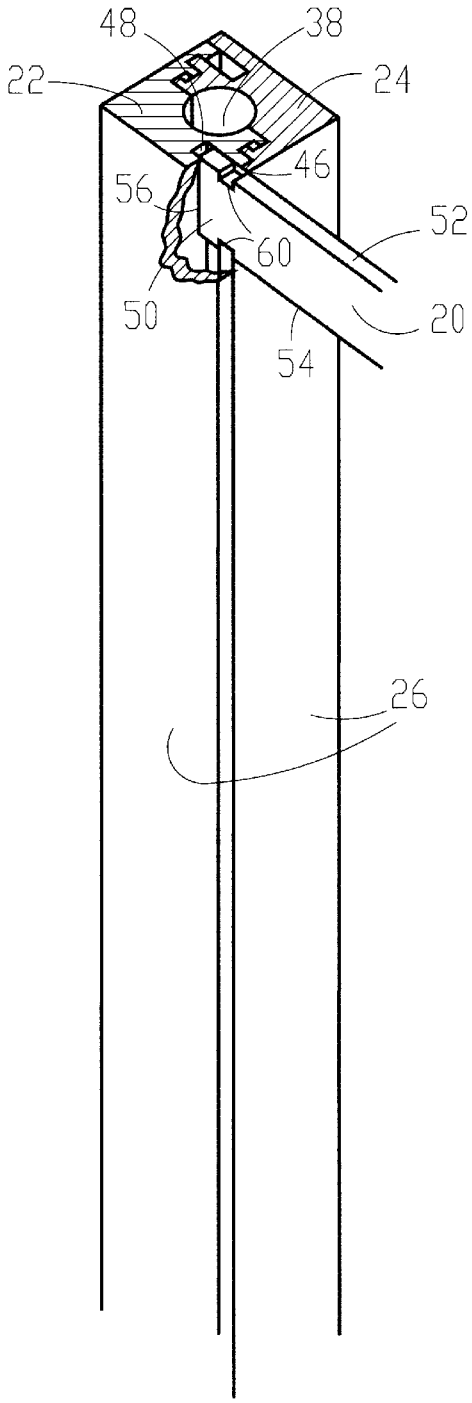
FIG. 3 is a sectional fragmentary view of the cart of FIG. 1 showing a post connected to a support rod, with a portion cut away for clarity.

As shown in FIGS. 3 and 4, a slot 46 formed within exterior sidewall 26 at the juncture of interlocking sides 22, 24 is configured to mateably engage a notched section of support rod 20. Slot 46 is formed by a rectangular cutout made along the outer edge of the outer wall of second side 24. In an alternative embodiment, the slot could be formed by smaller cutouts made along adjacent outer edge portions of each side. While the shape of slot 46 is rectangular in the embodiment shown in the drawings in order to conform to the shape of support rod 20, it should be understood that any other shape of slot could be used provided it is configured to mate with the rod.

Figure 5:
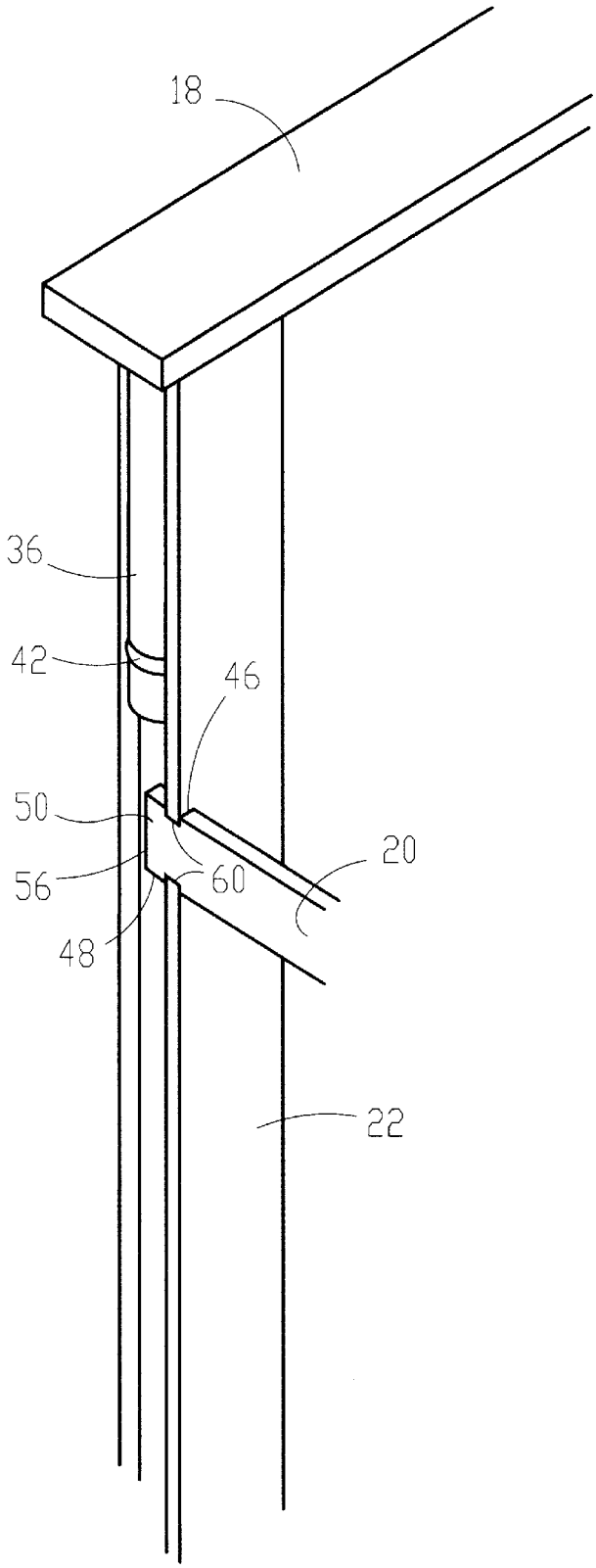
FIG. 5 is a fragmentary perspective view of the cart of FIG. 1, showing the top of a post connected to a support rod with an upper locking pin in place, with one of the interlocking sides of the post being removed for clarity.

As shown in FIGS. 2, 3 and 5, internal cavity 48 formed by a cavity cutout in side 22 is accessible via slot 46. Cavity 48 is configured to receive an end section 50 of support rod 20. In the embodiment shown in the drawings, cavity 48 is rectangular in shape extending vertically along the entire length of post 12. It should be understood, however, that other shapes and sizes are suitable for purposes of this invention provided the cavity is suitable for receiving end section 50.

Looking to FIGS. 1, 3 and 4, each support rod 20 has a top edge 52 and a bottom edge 54 extending between a first end 56 and second end 58. A pair of notches 60 are cut out of each support rod 20 near each end 56, 58 of the rod. The notches 60 are provided along top edge 52 and bottom edge 54 in opposed position, and are configured to receive the top and bottom edges of slot 46. In this manner, the section of rod extending between the notches can fit snugly within slot 46. While the notches are generally square in shape to conform to the cross-sectional shape of the outer wall of side 22, notches 60 could be any shape that would enable support rod 20 to engage slot 46. Support rod 20 has an end section 50 at each end extending from notches 60 to each end 56, 58 respectively. End section 50 is configured to fit within cavity 48.

The width and height of support rod 20 is determined by the amount of weight they must support. The length of support rod 20 is determined by the desired dimensions of cart 10. Preferably, support rods 20 are rectangular bars made from aluminum. In a preferred embodiment, support rods 20 are rectangular aluminum bars having a cross sectional measurement of ⅛ inch by ⅝ inch. In the embodiment shown in the drawing, two of the shelves are formed by support rods that are bent outwardly in an arc near the center of the cart (FIG. 1). This rounded configuration is particularly useful for supporting round trays as shown in the dotted lines. Of course, it should be understood that various sizes, shapes and configurations of support rods could be used for purposes of the present invention.

Looking to FIG. 1, slots 46 are vertically spaced along the length of each post 12 at the location of a desired shelf. Support rods 20 are connected at each end to a front and rear post 12 via the slots. The pair of opposed notches 60 in the rod mateably engage slot 46 and end section 50 is secured within cavity 48. In this manner, the rod is held in its desired location to form the shelf as long as sides 22, 24 remain in the interlocked position.

To assemble cart 10, it is necessary to start with interlocking sides 22, 24 of each post in the unlocked position. In this position, the notched portion of each support rod 20 can be fitted into a corresponding slot 46 such that the notch 60 receives the bottom and top edge respectively of the slot. Next, the interlocking sides 22, 24 of the post are fitted together into the interlocking position. In order to accomplish this, end section 50 of each support rod is guided into cavity 48 and fingers 30 of each side are slid within corresponding spaces 32 of the other side. Thus, each side's fingers are in interlocking abutment with corresponding fingers of the other side. In this interlocked position, the support rod 14 is fixably connected to the post. This process is repeated for the second post to which the support rods are intended to be connected. Thus, in the embodiment shown in the drawings. A series of support rods are first connected to a front post and then connected to a rear post to form a right side of cart 10. A second series of support rods are connected to the other front post and then connected to the other rear post to form a left side of cart 10.

Looking to FIG. 2, once the support rods are connected to posts 12, cover slats 18 are secured over the top of front and rear posts 12 respectively by inserting locking pins 36 into the top of locking channel 38 of each respective post. Looking to FIG. 4, each stabilizing rod 16 is fitted over locking pin 36 of two stem casters 14 via hole 44. The locking pin of each stem caster 14 is then inserted into the bottom of the locking channel 38 of a post, such that the stabilizing rods 16 extend between the two front and the two rear posts respectively.

Cover slats 18 and stabilizing rods 16 serve not only to connect the left and right sides of the cart together, but also provide increased stability to the cart so as to prevent the cart from "parallelogramming", the condition where support rods 20 remain in a substantially horizontal position but posts 12 move out of their substantially vertical position.

Although the most preferred embodiment of the present invention is a shelving cart 10, a connection assembly comprising a post and an extension member in accordance with this invention can be used in many applications. In the preferred embodiment, the extension member is support rod 20, but the extension member could be any component needed to extend from and connect to the post. Similarly, the post could have a variety of configurations and could form a part of a larger component of a product. The post may be connected to a number of extension members or only one extension member. The extension member could be secured at either end to a post or could be mounted as a cantilever to a single post. Furthermore, the extension member could engage more than one slot on a single post or several posts.

Figure 6:
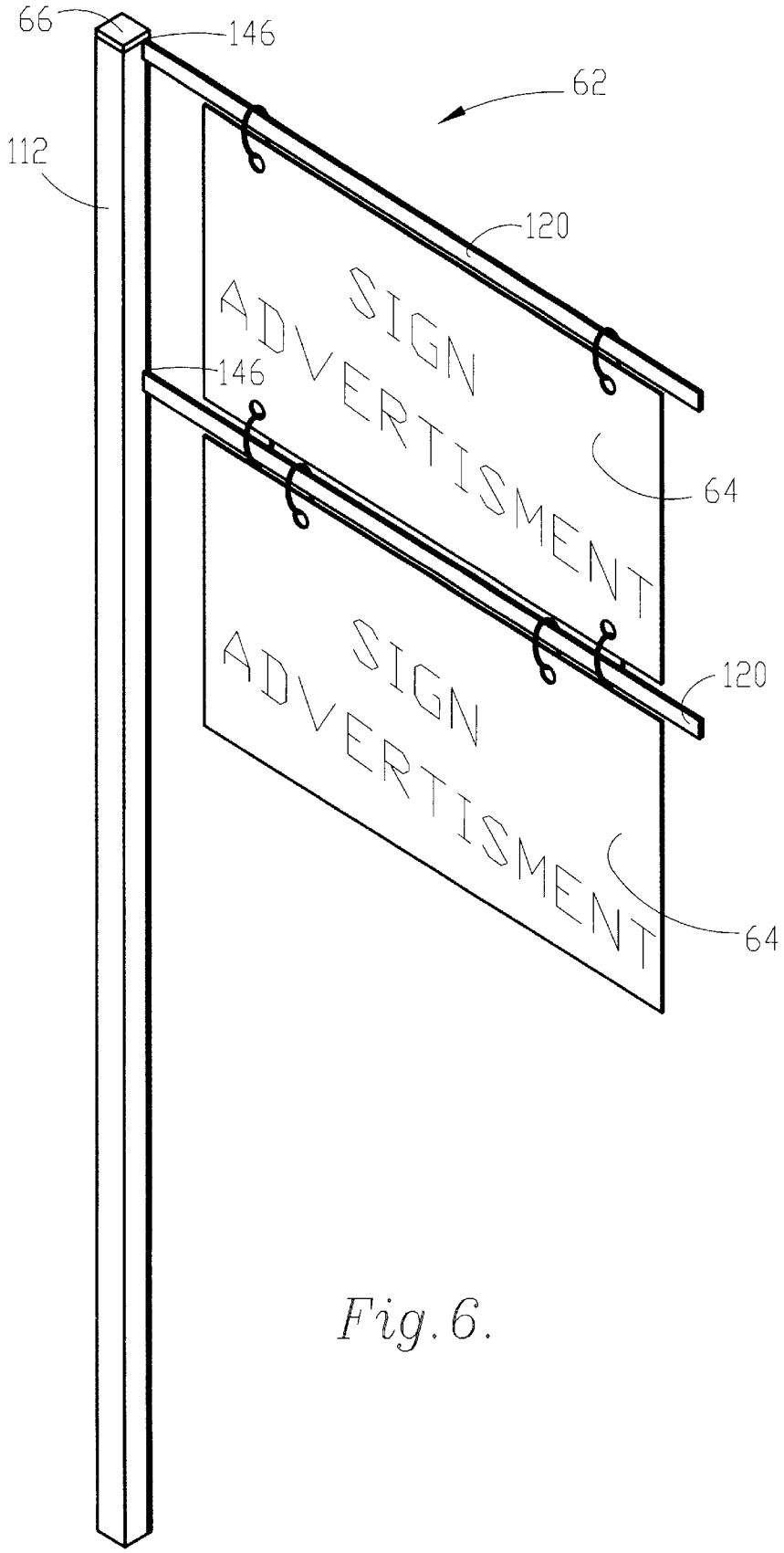
FIG. 6 is a perspective view of a signpost in accordance with a preferred embodiment of the present invention.

For example, a connection assembly in accordance with this invention can be used in conjunction with a signpost generally designated by the numeral 62 in FIG. 6. Signpost 62 includes a post 112 as previously described having two interlocking sides. Two slots 146 at the juncture of the interlocking sides are configured to engage notched sections of a sign support 120 and provide an opening to an internal cavity (not shown) within the post to retain an end section of the sign support. Sign supports 120 are held within slots 146 and extend outwardly as a cantilever to support a sign 64. A locking pin (not shown) integrally formed with cap 66 may be inserted into the top of a locking channel (not shown) within the interior of the post to hold the two interlocking sides in the interlocked position.

From the foregoing it will be seen that this invention is one well adapted to attain all ends and objectives herein above set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed is:

1. A shelving unit comprising:

at least one post comprising a first side and a second side releasably interlocked together along a juncture therebetween, said post comprising an exterior sidewall and a cavity defined by said interlocked sides; and at least one support rod comprising a first end, a pair of opposed notches near said first end and an end section extending from said notches to said first end, wherein said exterior sidewall defines a slot along said juncture configured to mateably engage and fixably hold said pair of opposed notches, and wherein said cavity is configured to receive said end section, wherein said end section is sized such that said end section cannot be fitted through said slot when said first and second sides are interlocked together.

2. The shelving unit of claim 1, wherein said shelving unit additionally comprises a locking pin, and wherein each of said sides include a plurality of fingers positioned adjacent one another so as to form a space between each finger, said first side fingers being configured to slideably fit within said corresponding spaces defined between said second side fingers when said sides are interlocked together, and wherein said interlocking sides further define a locking channel therebetween that is configured to receive said locking pin to prevent said first side fingers from moving out of said corresponding spaces defined between said second side fingers.

3. The shelving unit of claim 2, wherein said locking pin is a stem from a stem caster.

4. The shelving unit of claim 2, wherein said locking channel is a vertically extending bore that substantially extends the length of said post.

5. The shelving unit of claim 1, wherein said first and second interlocking sides are symmetrical.

6. The shelving unit of claim 1, wherein said support rod includes at least one pair of rectangularly shaped opposed notches configured to engage said slot.

7. The shelving unit of claim 1, wherein said internal cavity is a vertical channel substantially extending the length of said post.

8. The shelving unit of claim 1, wherein said unit comprises four said posts and a plurality of said support rods, wherein each of said support rods has at least one pair of opposed notches on a first and second end of the rod and wherein at least one said slot for mateably engaging said opposed notches is provided along the exterior sidewall of each said post.

9. The shelving unit of claim 1, wherein said support rod is an elongated rectangular bar extending from a first end to a second end having a pair of opposed notches located near each end.

10. The shelving unit of claim 1, wherein said first and second sides each include a plurality of fingers positioned adjacent one another with spaces therebetween, the fingers of said first side having a first abutment wall and the fingers of said second side having a second abutment wall corresponding with and parallel to said first abutment wall, wherein said fingers of said first side are configured to fit within corresponding spaces of said second side such that said first and second abutment walls are in abutment with each other thereby preventing movement of the sides relative to one another in a direction transverse said abutment walls.

11. A connection assembly comprising:

an extension member extending from a first end to a second end;

a post comprising a first side and a second side releasably interlocked together to define a juncture therebetween, wherein at least one of said sides defines a slot along said juncture configured to mateably receive said extension member, said extension member including an end section configured to be held within said post, said end section being larger than said slot such that said extension member cannot be removed from said post when said first and second sides are in said interlocked position, and wherein said first and second sides each include a plurality of fingers positioned adjacent one another with spaces therebetween, the fingers of said first side having a first abutment wall and the fingers of said second side having a second abutment wall corresponding with and parallel to said first abutment wall, wherein said fingers of said first side are configured to fit within corresponding spaces of said second side such that said first and second abutment walls are in abutment with each other thereby preventing movement of the sides relative to one another in a direction transverse said abutment walls.

12. The connection assembly of claim 11, wherein said connection assembly additionally comprises a removable locking pin, and wherein said first and second sides define a locking channel therebetween that is configured to receive said locking pin to substantially prevent movement in a direction parallel with said abutting walls.

* * * * *